US005504970A

United States Patent [19]

Neshat et al.

[11] Patent Number: 5,504,970

[45] Date of Patent: Apr. 9, 1996

[54] HAND-HELD VACUUM CLEANER

[75] Inventors: Amir M. Neshat, Jonesboro; Clifford E. Hufstedler, Walnut Ridge, both of Ark.

[73] Assignee: The Scott Fetzer Company, Westlake, Ohio

[21] Appl. No.: 265,417

[22] Filed: Jun. 24, 1994

[51] Int. Cl.[6] ..... A47L 5/26

[52] U.S. Cl. ..... 15/334; 15/344; 15/353

[58] Field of Search ..... 15/344, 331, 332, 15/334, 377, 353

[56] References Cited

U.S. PATENT DOCUMENTS

| | | | |
|---|---|---|---|
| 1,800,854 | 5/1932 | Engberg et al. | 15/416 |
| 2,218,035 | 10/1940 | Benson . | |
| 2,592,710 | 4/1952 | Kirby | 15/377 |
| 2,876,481 | 3/1959 | Gerber et al. | 15/331 |
| 4,175,352 | 11/1979 | Catlett . | |
| 4,316,304 | 2/1982 | Parise et al. . | |
| 4,357,730 | 11/1982 | Lex . | |
| 4,542,557 | 9/1985 | Levine | 15/344 |
| 4,800,615 | 1/1989 | Ostroski et al. . | |
| 4,928,346 | 5/1990 | Elson et al. | 15/377 |
| 4,939,810 | 7/1990 | Ataka . | |
| 4,993,108 | 2/1991 | Genge et al. . | |
| 5,086,536 | 2/1992 | Lackner et al. . | |
| 5,105,505 | 4/1992 | Reed, Jr. . | |
| 5,129,128 | 7/1992 | Bowerman et al. . | |
| 5,230,722 | 7/1993 | Yonkers . | |
| 5,331,716 | 7/1994 | Hemmann et al. | 15/332 |

OTHER PUBLICATIONS

Injection Molding, Dec. 1993, p. 25, for *Black & Decker's latest plug in hand vac.*

*Primary Examiner*—David Scherbel
*Assistant Examiner*—Reginald L. Alexander
*Attorney, Agent, or Firm*—Watts, Hoffmann, Fisher & Heinke

[57] ABSTRACT

A hand-held vacuum cleaner includes a housing. A nozzle is attached to and laterally offset from the housing and a brushroll is supported for rotation in the nozzle. A power drive is connected to the bushroll. A collection container is supported by the housing. A conduit external of the housing has one end detachably connected to the nozzle and another end communicating with the collection container. A vacuum source creates an airflow through the conduit to the collection container. An on-board cleaning tool is carried by the housing. The tool is removable from the housing for connection to the conduit when the one end is detached from the nozzle. The power drive includes a disconnect which stops bushroll rotation when the conduit is detached from the nozzle.

16 Claims, 5 Drawing Sheets

HAND-HELD VACUUM CLEANER

TECHNICAL FIELD

The present invention relates in general to vacuum cleaners, and more specifically to a new hand-held vacuum cleaner.

SUMMARY OF THE INVENTION

The present invention is directed to a hand-held vacuum cleaner that provides a novel combination of features, including wet and dry collection, revolving brushroll pick-up, a specially constructed nozzle or head capable of entering and cleaning low clearance areas, a flexible hose communicating the nozzle with a collection container, a powerful vacuum source independent of the brushroll motor, and one or more on-board tools for detailing. All of these features contribute to a versatile, convenient and high performance operation which is unique in the field of plug-in and cordless hand-held vacuum cleaners.

In one embodiment the new hand-held vacuum cleaner comprises a housing having an inlet nozzle and a collection container. A hose external of the housing provides a flow path from the nozzle to the collection container during one normal mode of operation of the vacuum cleaner. The hose can be uncoupled from the nozzle and used for vacuuming or "detailing" areas that are difficult to access. One or more detailing tools can be carried on-board the housing for attachment to an end of the hose when it is disconnected from the nozzle. In a preferred embodiment, an extendable wand is telescopically mounted in the hose for enhancing use of the vacuum cleaner for detailing work.

A preferred construction includes a revolving brushroll located in the nozzle. Revolving of the brushroll is stopped when the hose is uncoupled from the nozzle for detail cleaning to avoid damaging a carpet or expelling debris from the nozzle. While a single power source can be used for creating a vacuum and actuating the brush, the present invention contemplates in a preferred form a brush motor, and a separate vacuum motor for creating the suction force in the housing. This results in a powerful vacuum source which enhances performance of the vacuum cleaner.

The nozzle preferably extends laterally beyond a side of the housing and has a low height relative to the height of housing. This construction enables the nozzle to extend into areas under low furniture, etc. which could not be reached by conventionally constructed hand-held vacuum cleaners.

In the disclosed embodiment, the vacuum cleaner is capable of both wet and dry collection, although it will be apparent that many of the new features discussed above are useful in dry vacuum cleaners. The disclosed wet and dry embodiment includes a passage in the housing communicating with the hose and a deflector surface in the passage above the collection container. When the vacuum motor is turned on, the inlet air flow impinges on the deflector surface so that dirt, debris and liquid separate from the airflow and fall into the collection chamber.

In accordance with the preferred embodiment of the invention, the vacuum motor is located downstream from the deflector surface and the collection container. The vacuum motor is cooled by the flow of air through the housing. A filter cartridge is located between the motor and deflector surface in order to remove any remaining dirt, debris and liquid from the air before passing over the vacuum motor.

Other features and a full understanding of the invention will be had from the following detailed description and accompanying drawings.

DESCRIPTION OF THE PREFERRED EMBODIMENT

Figure 1:
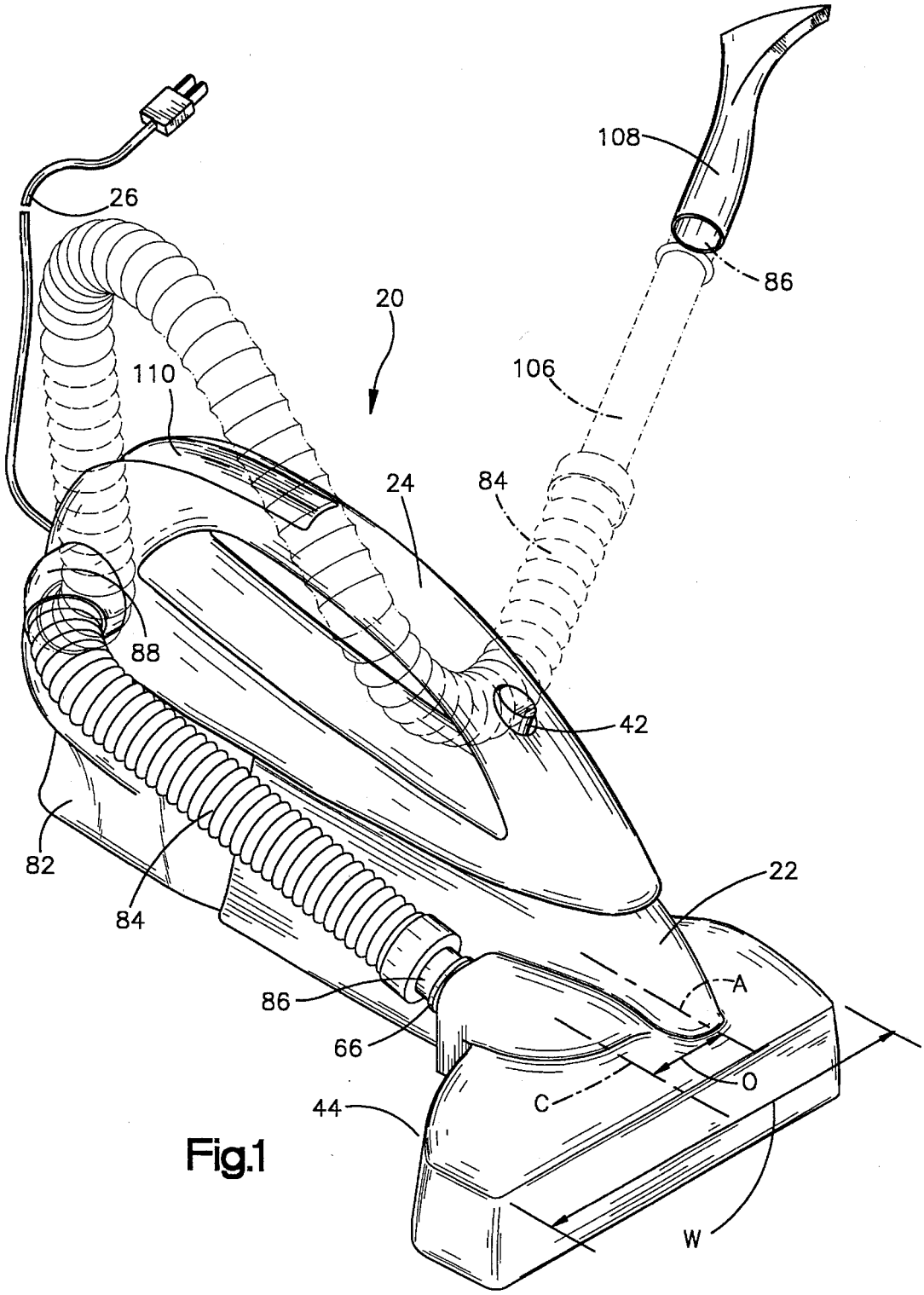
FIG. 1 is a perspective view of a preferred embodiment of the vacuum cleaner embodying the present invention.
Figure 2:
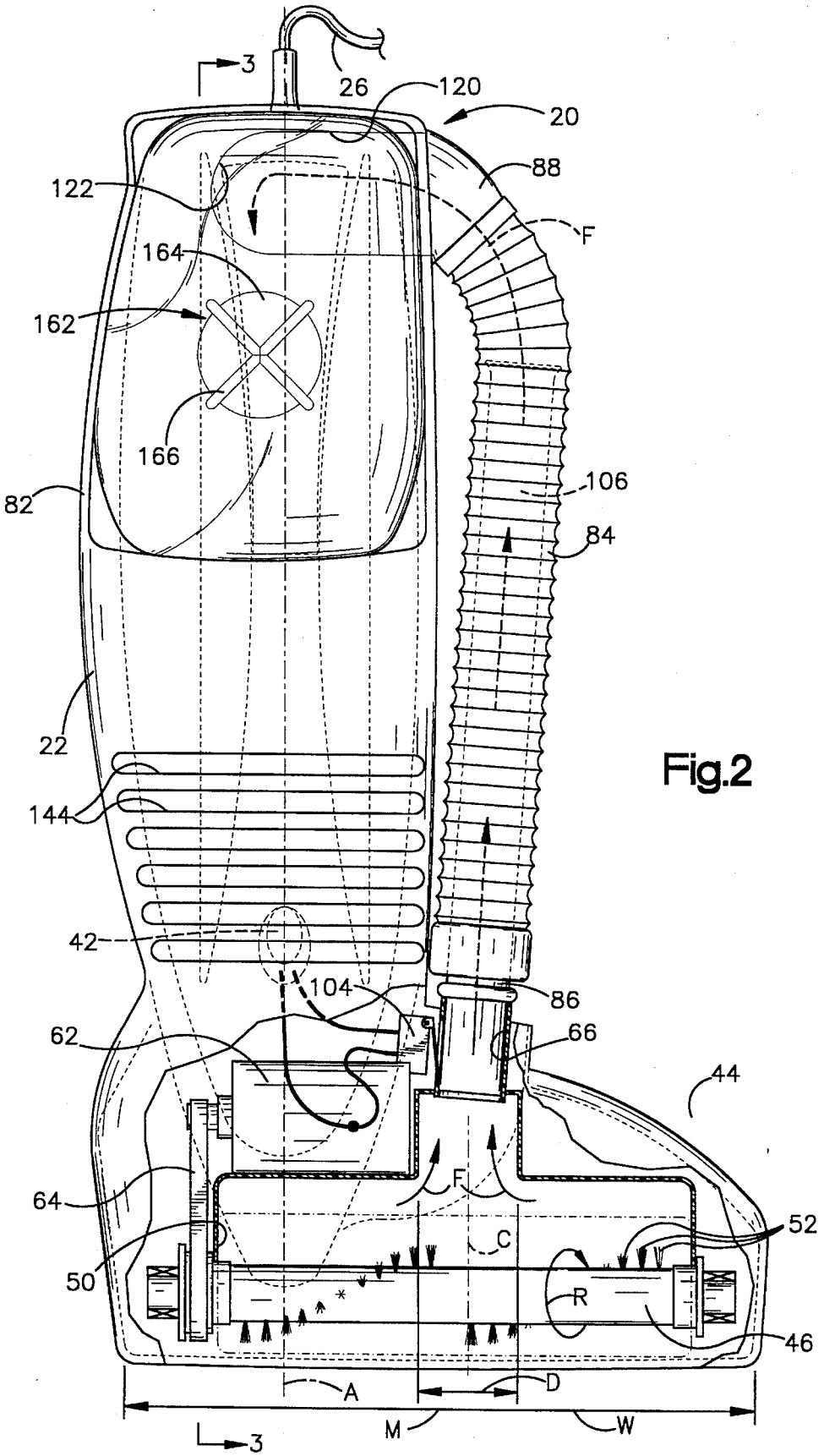
FIG. 2 is a bottom plan view of the vacuum cleaner of FIG. 1 with parts broken away for clarity.
Figure 3:
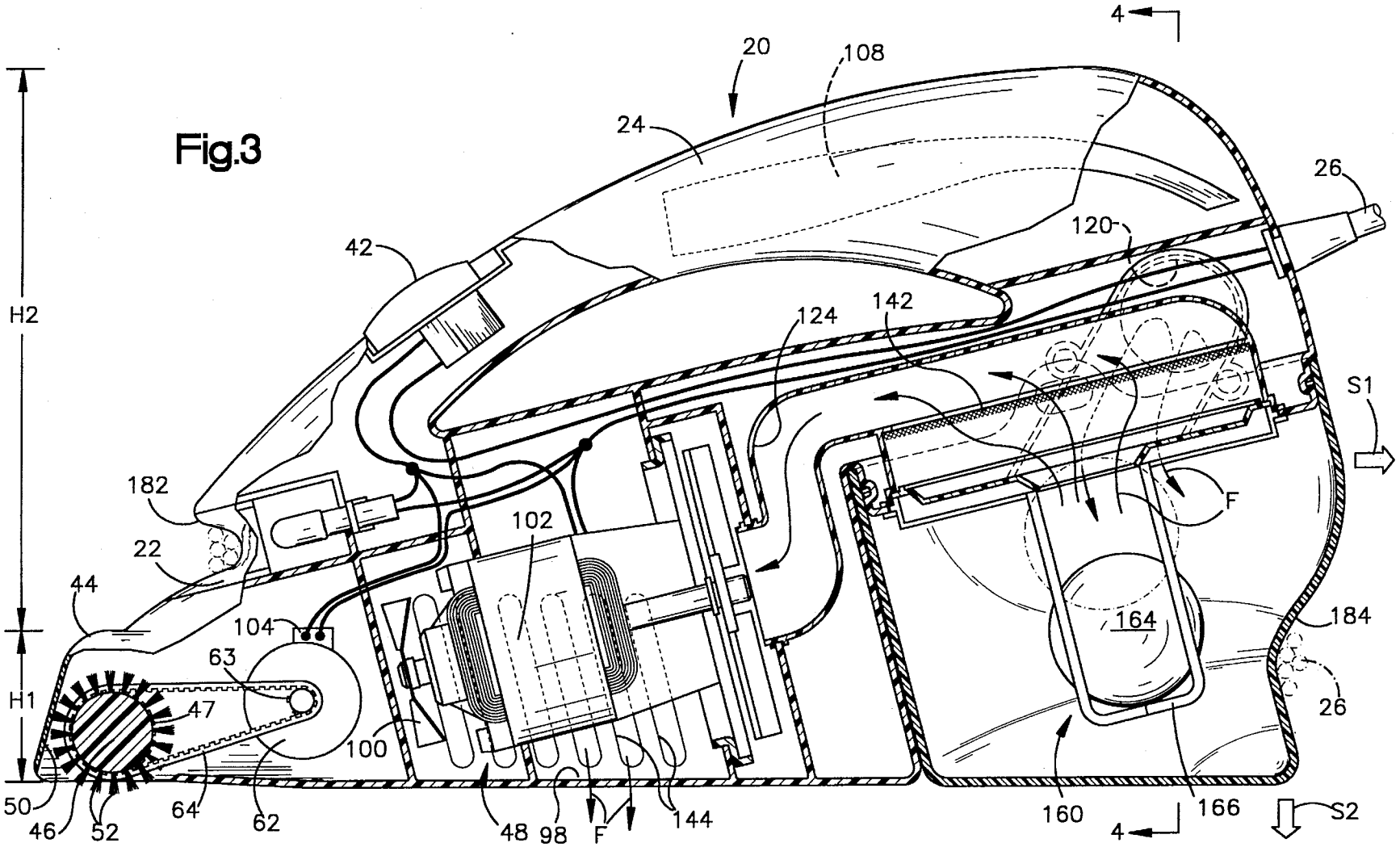
FIG. 3 is a side elevational view, partly in section, taken approximately along the line 3—3 in FIG. 2.

Referring now to the drawings, and to FIGS. 1, 2 and 3 in particular, the illustrated embodiment of the present invention is a corded hand-held vacuum cleaner 20 capable of wet and dry collection. The vacuum cleaner 20 is generally comprised of a molded plastic housing 22 having a nozzle 44 at its forward end, a collection container 82 at its back end, and a flexible vacuum cleaner hose 84 separate from and external to the housing. In one mode of operation, the hose 84 provides a flow path from the nozzle 44 to the collection container 82. The housing 22 also includes an integrally molded handle 24.

As shown most clearly in FIGS. 2 and 3, a brushroll 46 is journaled in the nozzle 44 at its inlet 50. A brushroll drive motor 62 is mounted in the housing 22 adjacent the nozzle 44 and is connected to the brushroll 46 by a toothed drive belt 64. As shown, the belt 64 is entrained around a gear 63 on the motor shaft and a gear 47 on the brushroll 46. Power is supplied to the brush drive motor 62 through the electrical cord 26 and is controlled by an ON/OFF switch 42.

A vacuum source 48 comprising another motor 102 also is mounted in the housing 22 and is electrically connected to the power cord 26 through the ON/OFF switch 42. The vacuum motor 102 is located in a chamber 98 in the housing 22 with its shaft and longitudinal axis extending in a direction substantially parallel to the axis A of the housing. A fan 100 is connected to the output shaft of the motor 102 and upon energization creates a vacuum force and resulting airflow F from the inlet 50 of the nozzle 44, through the hose 84 and in the housing 22.

The flexible hose 84 is provided as a conduit to conduct dirt, debris and/or liquid laden airflow F from an outlet port 66 of the nozzle 44 to a portion of the housing 22 located above the collection container 82. The flexible hose 84 is external of the housing 22. The airflow F created by the vacuum source 48 enters the housing 22 from the flexible hose 84 at a swivel joint 88 and is directed into a passage 120 (FIG. 4) formed in the housing. The airflow F is directed through the passage 120 and engages a deflector surface 122 located at an end of the passage opposite the swivel joint 88 above the collection container 82. The deflector surface 122 is preferably integrally molded into the housing 22.

Figure 4:
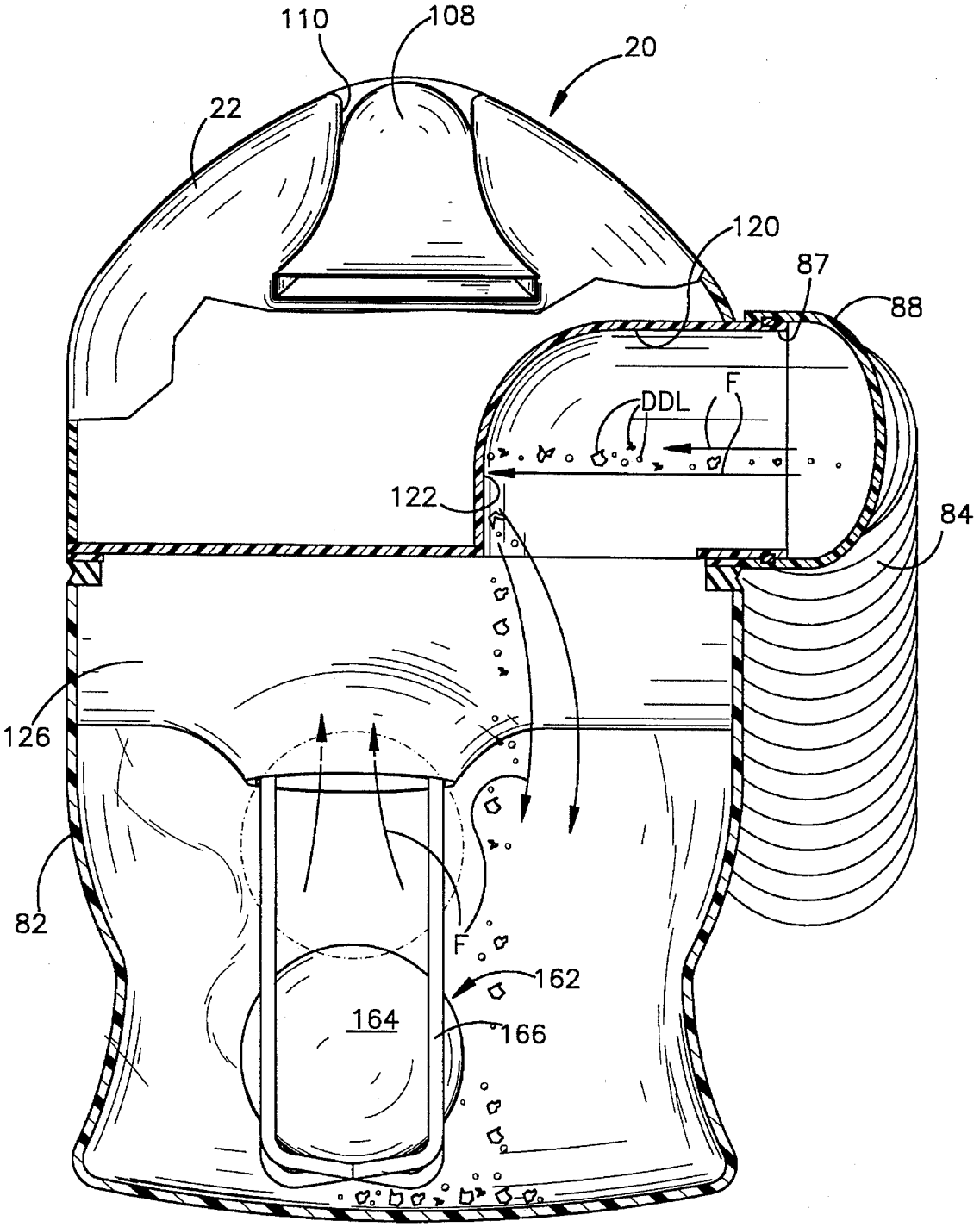
FIG. 4 is a rear-elevational view, partly in section, taken approximately along the line 4—4 in FIG. 3.

In use, the deflector surface 122 directs the airflow F downwardly into the collection container 82. The deflector surface 122 also separates any dirt, debris and/or liquid carried by the airflow F when the dirt, debris and liquid particles impact the deflector surface. Dirt, debris and liquid particles are separated from the airflow F when they impinge on the deflector surface 122 and fall to the bottom of the collection container 82, as illustrated in FIG. 4.

The collection container 82 is removably mounted in the housing 22 and is preferably molded from a substantially transparent plastic material to serve as a receptacle capable of storing dirt, debris and liquid (FIG. 4) that is separated from the airflow F. The transparent collection container 82 enables the operator of the vacuum cleaner 20 to visually tell when the collection container is full and requires emptying.

Also located within the collection container 82 is a ball float mechanism 162 which allows unimpeded airflow F into a passage 124 while liquid stored in the collection container 82 is at a relatively low level. The ball float mechanism 162 includes a relatively lightweight ball 164 supported in a cage 166. The cage 166 permits substantially linear movement of the ball 164 towards and away from a cartridge 126. The ball 164 is sized larger than an opening 180 in the bottom of the cartridge 126 which leads to the passage 124. When the liquid located within the collection container 82 rises to a predetermined level, the ball 164 engages the surface defining the opening 180 and closes off the passage 124. The flow of air is blocked to prevent liquid from contacting the vacuum motor 102.

The airflow F downstream of the collection container 82 enters the passage 124 (FIG. 3) which is at least partially defined by the filter cartridge 126. The airflow F passes through the cartridge 126 and a filter 142 to remove particles of dirt, debris and/or liquid which were not separated from the air at the deflector surface 122. The filter 142 is supported in the cartridge 126 to expose a maximum amount of filtering area to the airflow F moving through the passage 124. The filter 142 is removable from the cartridge 126 so it can be replaced easily and inexpensively without having to replace the entire cartridge.

The portion 124 acts as an inlet to the chamber 98 in the housing 22. The relatively clean airflow F entering the chamber 98 is directed over the vacuum motor 102 to cool the motor. The airflow F is then exhausted from the chamber 98 to the surrounding atmosphere from openings 144 in the sides and bottom of the housing 22.

The nozzle 44 is constructed so that it can reach under low furniture, etc., to enhance the versatility and cleaning capability of the vacuum cleaner 20 when it is used in one mode of operation. The nozzle 44 has a width W (FIG. 1) taken in a direction normal to a longitudinal central axis A of the housing 22. The width W of the nozzle 44 is wider than the width of the housing 22. The outlet port 66 of the nozzle 44 has a centerline C that is laterally offset from the housing 22 and its axis A by a distance O.

In one exemplary construction, the offset portion of the nozzle 44 has a height H1 (FIG. 3) that is approximately thirty percent of the total height H2 of the overall height H2 of the housing 22. The offset portion of the nozzle 44 enables the vacuum cleaner 20 to reach under low clearance furniture for a relatively long distance which generally cannot be achieved by known hand-held vacuum cleaners.

In the exemplary construction, the outlet port 66 has a width D (FIG. 2) which is less than twenty five percent of the nozzle width W, and preferably is approximately twelve percent of the nozzle width. The outlet port 66 is located along the midpoint M of the width W of the nozzle 44 and substantially at the middle of the brushroll 46. Any dirt, debris or liquid created by rotation of the brushroll 46 has a minimum distance to travel inside the inlet portion 50 of the nozzle 44 to reach the outlet port 66 and the relatively strong airflow F created by the vacuum source 48. There is a minimum chance that the dirt, debris or liquid DDL will impinge upon a surface in the inlet portion 50 of the nozzle 44 and separate from the airflow F.

In operation, the vacuum cleaner 20 cleans relatively large surface areas, such as carpeting, flooring, steps or the like. In this mode of operation, the vacuum cleaner 20 is manually moved over the surface so the brushroll 46 agitates the carpeting or other surface so dirt, debris and/or liquid DDL is introduced into the airflow F when created by the vacuum source 48 in the nozzle 44. The dirt, debris and liquid DDL is carried from the nozzle 44, through the hose 84 and into the passage 120. The dirt, debris and liquid DDL is separated from the airflow F by the deflector surface 122 above the collection container 82 and then is gathered in the collection container. The mostly clean airflow F enters the opening 180 in the cartridge 126 when liquid in the collection container 82 is below the predetermined level. The airflow F then passes through the filter 142 to remove any dirt, debris and liquid not separated by the deflector surface 122. Clean airflow F enters the passage 124, chamber 98 to cool the vacuum motor 102 and then exits the housing 22 through openings 144.

In a "detailing" mode of operation, the vacuum cleaner 20 is used to clean relatively smaller surface areas that are difficult to access in the normal mode of operation. At its forward end 86, the hose 84 is detachably connected to the outlet port 66 of the nozzle 44. When the first end portion 86 of the flexible hose 84 is detached from the nozzle 44, the hose may be extended to approximately four times its nonextended length. The first end 86 of the flexible hose 84 may then function in a "detailing" mode of operation as a separate inlet to the airflow F created by the vacuum source 48 for cleaning the hard to reach areas. The rear end of the hose 84 is connected to a port 87 at the back of the housing 22 through the swivel joint 88. The swivel joint 88 is at a location on the side of the housing 22 above the collection container 82 and is able to rotate 360° around the port 87.

Figure 5:
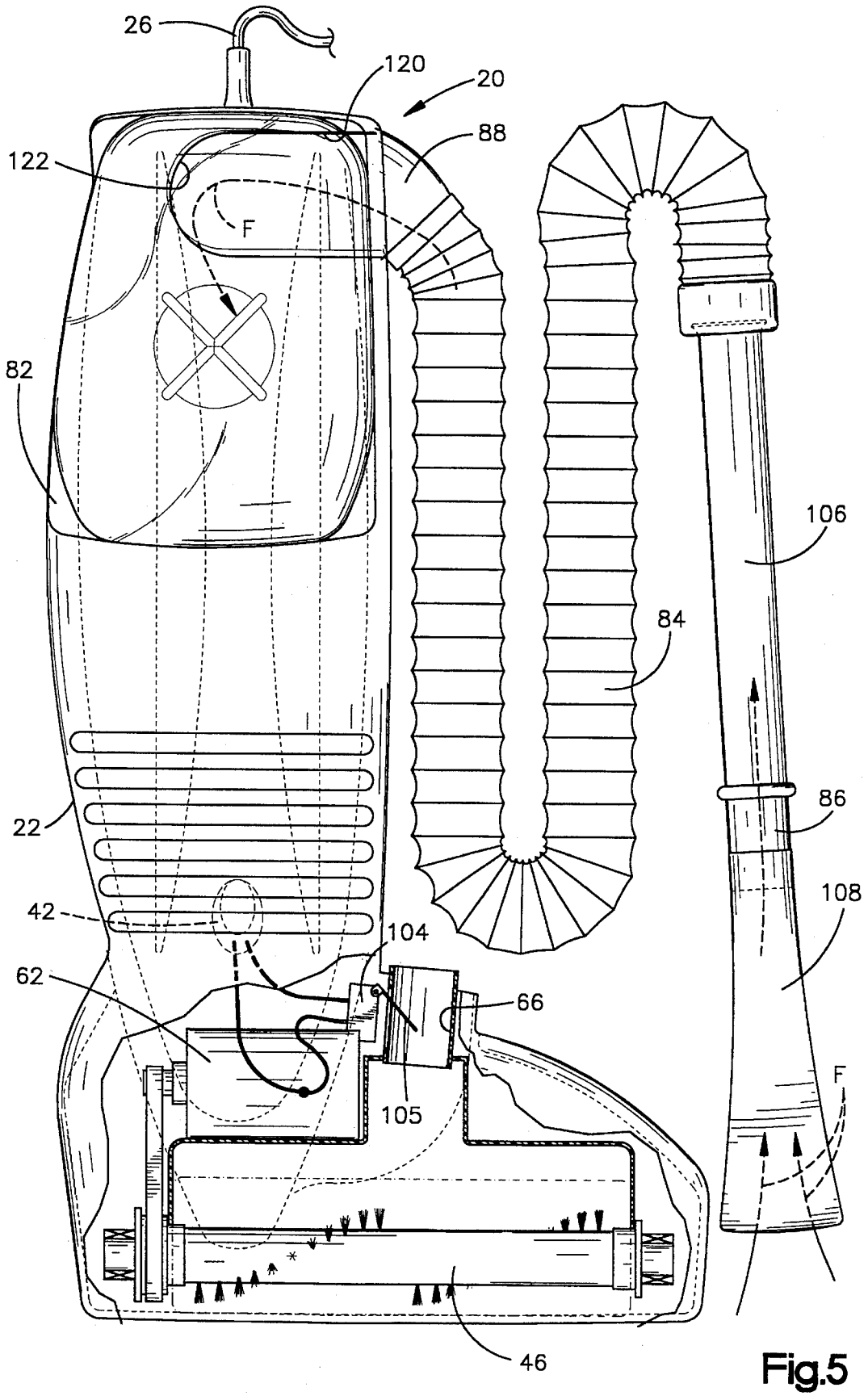
FIG. 5 is a view similar to FIG. 2 with parts in different positions.

When the flexible hose 84 is disconnected at the forward end portion 86 from the outlet port 66 in the nozzle 44, a disconnect switch 104 in the outlet port senses the absence of the forward end portion of the flexible hose. The disconnect switch 104 disconnects electrical power from the ON/OFF switch 42 to the brushroll drive motor 62 to stop rotation of the brushroll 46. FIG. 5 illustrates the disconnect switch 104 having a lever 105 moved to its disconnecting position when the first end 86 of the flexible hose 84 is removed from the outlet port 66. This is a desirable feature during use of the flexible hose 84 for detail cleaning because damage to a surface supporting the vacuum cleaner 20 from rotation of the brushroll 46, or damage from dirt or debris discharged from the outlet port 66 due to rotation of the brushroll, is eliminated. When the first end 86 of the flexible hose 84 is in the outlet port 66, the lever 105 is in the position illustrated in FIG. 2 and the disconnect switch 104 connects electrical power to the brushroll drive motor 62 to enable rotation of the brushroll 46. The flexible hose 84 carries a wand 106 in a telescoping relationship at the forward end 86. The wand 106 is extendable from within the flexible hose 84 to direct the airflow F from the vacuum source 84 and can function as an extended separate inlet to the airflow F. An accessory detail cleaning tool 108 (FIGS. 1 and 5), such as a crevice tool or the like, is carried on-board the housing 22. The tool 108 is received in a recess 110 molded in the housing 22. When the tool 108 is removed from the recess 110 in the housing 22 it can be attached to the forward end 86 of the wand 106 to concentrate the vacuum force in hard to reach areas for detail cleaning.

It will be apparent that the illustrated embodiment of the invention is capable of achieving a combination of functional advantages not possessed by prior art hand-held vacuum cleaners. The detachable and flexible hose 84 enables the vacuum cleaner 20 to operate as a normal hand-held mode that is capable of wet and dry collection. The rotating brushroll 46 in the laterally offset nozzle 44 provides effective cleaning of substantially flat and accessible surfaces under low clearance furniture. The flexible hose 84, when detached from the nozzle 44, enables "detail" cleaning of hard to reach areas. The on-board wand 106 and on-board accessory tool 108 further enhance the detail cleaning capabilities of the vacuum cleaner 20. The vacuum motor 102 is dedicated solely to providing a vacuum force and the brushroll drive motor 62 is dedicated solely to rotating the brushroll 46. Rotation of the brushroll 46 ceases when the flexible hose 84 is detached from the nozzle 44 for detail cleaning.

Having described at least one preferred embodiment of the invention, what is claimed is:

1. A hand-held vacuum cleaner for wet and dry operation comprising:

a housing having a nozzle;

a brushroll supported for rotation in said nozzle;

a power drive operably connected to said brushroll;

a collection container for fluids and dirt supported by said housing;

a flexible conduit external of said housing providing an airflow path between said nozzle and said collection container;

a vacuum source for creating an airflow through said conduit to said collection container;

said conduit having one end detachably connected to said nozzle, whereby said vacuum cleaner can be used for detailing when said one end of said conduit is detached from said nozzle to serve as a separate inlet for dirt and debris, and wherein said collection container is located in the airflow upstream of said vacuum source.

2. A vacuum cleaner as claimed in claim 1 including a wand telescopically mounted in said conduit, said wand being extendable from said conduit when said conduit is detached from said nozzle.

3. A vacuum cleaner as claimed in claim 1 including an on-board cleaning tool carried by said housing, said tool being removable from said housing for connection to said one end of said conduit when said conduit is detached from said nozzle.

4. A vacuum cleaner as claimed in claim 1 wherein said power drive includes an electric disconnect switch for stopping rotation of said brushroll when said conduit is detached from said nozzle.

5. A vacuum cleaner as claimed in claim 1 wherein said power drive comprises a first electric motor and wherein said vacuum source includes a second electric motor and a fan.

6. A vacuum cleaner as claimed in claim 1 including a deflector for causing dirt, debris and liquid to be separated from the airflow by contacting said deflector and to be stored in said collection container.

7. A vacuum cleaner as claimed in claim 6 further including a valve to prevent liquid in said collection container from being drawn into an electric motor associated with said vacuum source when liquid in said collection container reaches a predetermined level.

8. A vacuum cleaner as claimed in claim 1 wherein said conduit is connected to said nozzle at a location that is laterally offset from a longitudinal central axis of said housing, and said nozzle extends beyond a side of the housing where said conduit is connected to said nozzle.

9. A vacuum cleaner as claimed in claim 1 further including a cartridge located in a passage extending between said collection container and said vacuum source for supporting a filter, said cartridge is supported by one of said housing and said collection container, said filter is removable from said cartridge and is supported by said cartridge.

10. A vacuum cleaner as claimed in claim 7 further comprising a passage between said collection container and said vacuum source and a ball float mechanism disposed in said collection container, wherein said ball float mechanism comprises a cage and a ball adapted for movement in the cage to block said passage when the liquid reaches said predetermined level.

11. A hand-held vacuum cleaner comprising:

a housing;

a vacuum source in said housing for creating an airflow;

a nozzle at one end of said housing;

a brushroll supported for rotation in said nozzle to introduce dirt and debris into the airflow;

a collection container supported at an end of said housing opposite said nozzle for receiving and storing dirt and debris from the airflow; and a flexible hose external of said housing for conducting dirt and debris laden airflow to said container, a first end of said hose detachably connected to a port in said nozzle and a second end of said hose connected to said housing at a location above said container wherein said collection container is located in the airflow upstream of said vacuum source.

12. A vacuum cleaner as claimed in claim 11 further including a valve adapted to prevent liquid in said collection container from being drawn into an electric motor associated with said vacuum source when liquid in said collection container reaches a predetermined level.

13. A hand-held vacuum cleaner for wet and dry operation, said vacuum cleaner comprising:

a housing;

a vacuum source in said housing;

a nozzle at one end of said housing, said nozzle defining an inlet opening for drawing dirt, debris and liquid into an airflow stream created by said vacuum source;

a collection container in the airflow stream upstream of the vacuum source and located at an end of said housing opposite said nozzle for receiving and storing dirt, debris and liquid;

a conduit for communicating dirt, debris and liquid laden airflow from said nozzle to a portion of said housing located above said container; and a surface in the airflow stream to redirect the airflow and to separate dirt, debris and liquid from the airflow, wherein said conduit comprises a flexible hose external of said housing for conducting the dirt, debris and liquid laden airflow to said collection container, a first end of said hose is detachably connected to an outlet port in said nozzle and a second end of said hose is connected to a side of said housing above said collection container.

14. The vacuum cleaner in claim 13 further including a brushroll supported for rotation by said nozzle.

15. The vacuum cleaner in claim 14 further including a first electric motor in said housing for rotating said brushroll, a second electric motor in said housing for driving a fan to provide the vacuum source and a switch in said outlet port for disconnecting electrical power to said first motor in response to said flexible hose being detached from said outlet port.

16. A vacuum cleaner as claimed in claim 13 further including a valve adapted to prevent liquid in said collection container from being drawn into an electric motor associated with said vacuum source when liquid in said collection container reaches a predetermined level.

* * * * *